US005819692A

United States Patent [19]

Schafer

[11] Patent Number: 5,819,692

[45] Date of Patent: Oct. 13, 1998

[54] PISTON COOLING OIL CONTROL VALVE

[76] Inventor: Timothy Vernon Schafer, 7719 Carrie La., South Lyon, Mich. 48178

[21] Appl. No.: 850,126

[22] Filed: May 1, 1997

[51] Int. Cl.[6] ..... F01P 5/10

[52] U.S. Cl. ..... 123/41.35

[58] Field of Search ..... 123/41.35, 41.34, 123/196 R, 196 M

[56] References Cited

U.S. PATENT DOCUMENTS 1,754,602 4/1930 Brillie ..... 123/41.35
3,709,109 1/1973 Howe .
4,114,571 9/1978 Ruf .
4,204,487 5/1980 Jones .
4,270,562 6/1981 Oberth .
4,667,630 5/1987 Sasaki .
5,517,959 5/1996 Kato et al. ..... 123/196 AB

*Primary Examiner*—John T. Kwon
*Attorney, Agent, or Firm*—Bill C. Panagos

[57] ABSTRACT

An engine lubricating system has a branch passage for supplying oil to spray nozzles targeted against the engine pistons for piston cooling purposes. A tubular valve element is slidably positioned in the main oil passage for controlling the flow of oil into the branch passage in accordance with the need for piston cooling. The tubular valve element is operated by a thermostatic power element in the main passage.

4 Claims, 2 Drawing Sheets

PISTON COOLING OIL CONTROL VALVE

BACKGROUND OF THE INVENTION

1. Field of the Invention

This invention relates to internal combustion engines, and particularly gasoline and diesel engines, and specifically to a control mechanism for spraying lubricating oil onto the pistons of such engines, whereby the temperature at the pistons is controlled within a preferred range, so that the pistons are prevented from overheating under high load conditions, or being overcooled under low load conditions.

2. Description of the Related Art

It is known that oil can be diverted from the engine lubricating system to spray nozzles targeted onto piston surfaces, whereby the pistons can be cooled, to prevent piston overheating. The diverter valves are operated by lubricant pressure or lubricant temperature, or any other form of electronically controlled servo motor, whereby full lubricant is delivered to the spray nozzles only under high-load conditions, i.e. when the lubricant is in a high pressure condition or a high temperature condition. It will be appreciated that many other types of parameters may be used, depending upon the ECM such as fuel input, etc.

U.S. Pat. No. 4,114,571, issued to M. Ruf discloses a thermostatically-operated valve for controlling the flow of cooling oil to a piston spray nozzle 6 when the oil is in a high temperature condition. The valve structure compresses a spool valve movable transverse to an oil passage system under the control of a small pilot valve mounted within the spool. A thermostatic power means is provided for opening or closing the pilot valve. The valve system is relatively complex and costly. Also the passage system required to deliver oil to and from the valve is relatively complex.

U.S. Pat. No. 4,204,487, issued to M. Jones, discloses an engine lubricating system having a pressure responsive valve 28 for diverting oil to piston spray nozzles 20 when the flowing lubricant is in a high pressure condition. In addition, at FIG. 2 thereof, the system of Jones is responsive to temperature. The specific structure of the valve is not shown in the patent drawing.

U.S. Pat. No. 4,270,562 shows and engine lubricating system that includes a pressure-responsive spool valve 24 arranged crosswise of a passage system containing a diverter line 18 for piston-coolant oil When the main line pressure in bore 44 exceeds a predetermined value the valve is shifted to admit oil into diverter line 18. Should the main line pressure increase to a value higher than necessary for engine lubrication purposes the valve spool will be deflected a further amount to open a bypass line 48.

SUMMARY OF THE INVENTION

The present invention is concerned primarily with a simplified direct-acting thermostatic valve that can be incorporated into a machined passage in an engine for diverting lubricant from the main oil gallery passage into individual branch passages leading to each piston spray nozzle. When the oil temperature is in a high temperature range the thermostatic valve is engaged and thereby responds to the need for piston-cooling. Conversely, the thermostatic valve acts to cease the flow of oil to the piston when oil cooling is not required.

The term "direct-acting" is herein used to reference a direct connection between the thermostatic power element and the valve that performs the oil diverting function. In preferred practice of the invention, the diverter valve comprises a hollow tubular wall slidable axially in the main oil passage for movement across a part formed by a branch passage leading from the main oil passage to the piston-cooling spray nozzles.

The tubular valve element is reciprocated back and forth in the main oil passage by a thermostatic power element located in the main passage, such that when the power element is heated by the flowing oil to a relatively high temperature a flow opening in the tubular wall registers with the branch passage port so as to divert oil into the branch passage. At relatively low oil temperatures, the tubular wall blocks flow of oil into the branch passage.

The use of a tubular valve is advantageous in that the valve can be operated with minimal power expenditure; the thermostatic power element can be a relatively small size device easily incorporated into the main oil passage. The opposite ends of the tubular valve element are subjected to essentially the same oil pressure so that the valve can be moved back and forth with a very low operating force.

In an alternate embodiment of the invention, a pressure responsive diverter valve is used to divert oil from the main oil passage into a branch passage leading to the piston cooling spray nozzles. The diverter valve has a tubular wall equipped with a flow opening, as in the thermostatically operated version.

The principal objects of the invention are to optimize engine piston temperatures under a variety of engine operating conditions, to optimize the flow of cooling oil to the piston spray nozzles, to achieve piston cooling commensurate with engine load requirements without sacrificing oil flow to other engine surfaces that require lubrication, and to generally minimize oil flow pumping requirements.

Further features of the invention will be apparent from the attached drawings and description of an illustrative embodiment of the invention.

THE DRAWINGS

DESCRIPTION OF A PREFERRED EMBODIMENT OF THE INVENTION

Figure 1:
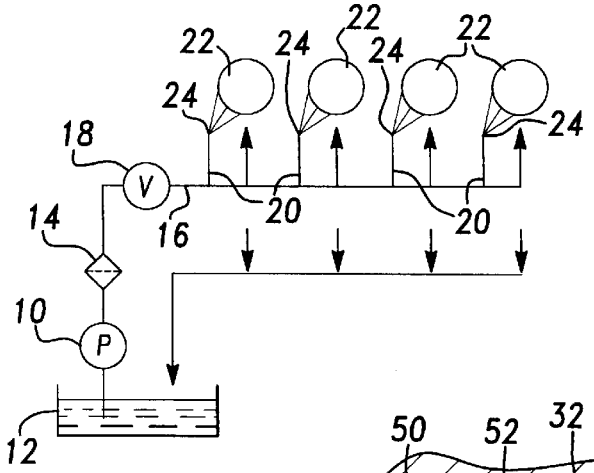
FIG. 1 is a schematic view of an engine lubricating system embodying the invention.
Figure 2:
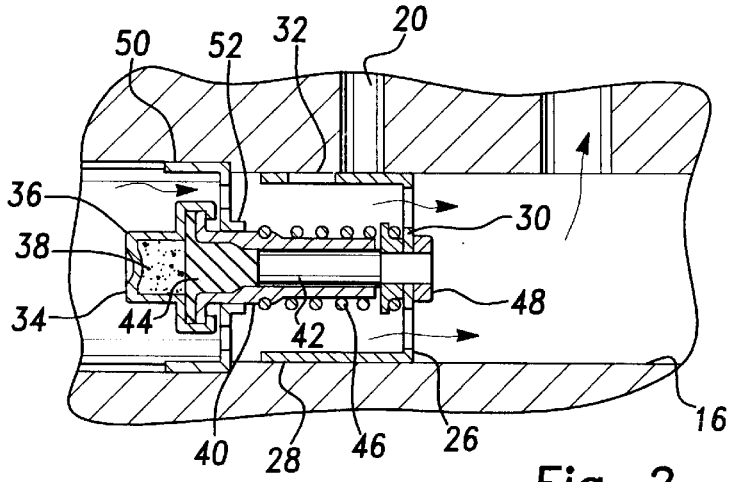
FIG. 2 is a sectional view taken through a thermostatically controlled oil diverter valve used in the FIG. 1 system.

Referring to FIG. 1 and 2, there is shown a piston engine lubricating system, and particularly a diesel engine lubricating system, that includes a pump 10 for pumping lubricating oil from sump (crankcase) 12 through filter 14 to a drilled main passage 16 in the engine cylinder block. A diverter valve 18 is located in passage 16 for diverting some of the lubricating oil into a branch passage 20 under some conditions, e.g. when it becomes necessary to spray cool the engine pistons.

FIG. 1 shows an engine having four pistons 22 and two spray nozzle assemblies 24; each spray nozzle assembly is designed to spray oil coolant onto one engine pistons, as in the arrangement depicted in aforementioned U.S. Pat. No. 4,204,487. However, in an alternate arrangement each nozzle assembly could be confined for use on a single piston, as shown e.g. in U.S. Pat. No. 3,709,109.

Main oil passage 16 supplies lubricating oil to various engine surfaces requiring lubrication, e.g. the main crankshaft bearings, cam shaft bearings, rocker arms, and valve lifter guides. Under low load conditions, and under cold engine operating conditions, diverter valve 18 is in a condition blocking flow from passage 16 into branch passage 20; the entire pump 10 output is used for engine lubrication purposes. When the engine is operating at a high engine temperature, e.g. under high loading, diverter valve 18 diverts some oil from passage 16 into the branch passage 20, whereby spray nozzles 24 spray the engine pistons with an atomized oil spray jet stream that has the effect of cooling and protecting the pistons against overheating.

FIG. 2 shows a preferred form that the diverter valve can take. The valve comprises a valve cam take. The valve comprises a valve element 26 that includes a hollow tubular wall 28 integral with a radial connection wall 20. A flow opening 32 is formed in tubular wall 28. The valve is shown in the position that it takes when the engine oil is in a relatively low temperature range, e.g. at engine start-up or under low load conditions at moderate speed. When the engine lubricant is in a high temperature range, e.g. at high engine loading, valve element 26 shifts rightward to a position wherein flow opening 32 is in registry with the associated port formed by branch passage 20; some of the oil in passage 16 flows through opening 32 into branch passage 20 for eventual discharge the spray nozzles 24 operated by a thermostatic power element 34 of the type that is commonly used in automotive water line thermostats.

As shown, the power element comprises a cup-like container 36 for containing a fusible pellet 38 that is a mixture of waxes, dispersed heat conductive particles, and a rubbery (vistanex) binder. The power element further comprises a guide cylinder 40, a cylindrical pin 42 slidable in the cylinder, and an elastomeric sealing plug 44 interposed between pellet 38 and the slidable pin 42. A tension pin return spring 46 has one end thereof attached to cylinder 40 and the other end attached to pin 42. A nut 48 is threaded onto the pin to secure the tubular valve element 26 to the exposed end to pin 42.

Thermostatic power element 34 is mounted in a coaxial position in passage 16 by means of an annular bracket 50. Inner edge area 52 of the bracket has press fit on guide cylinder 40, whereas the outer edge area of the bracket has a press fit on the wall of passage 16. The power element housing thus has a stationary coaxial position in passage 16, whereby the following lubricant washes container 36 as it passes along passage 16 in a left-to-right direction.

Figure 3:
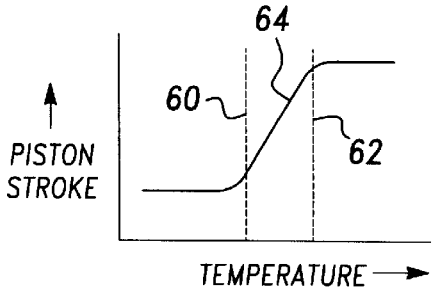
FIG. 3 is a chart depicting the performance of a thermostatic power element incorporated into the FIG. 2 valve.

The wax mixture in expansion pellet 38 comprise a range of different hydrocarbons, such that the pellet expands over a range of temperatures, rather than a single temperature. FIG. 3 shows the general performance of the thermostatic power element. Temperature increase up to a transition temperature 60 produces no substantial motion of pin (piston) 42. Between temperature 60 and temperature 62 the waxes in pellets 38 transitions from a solid condition to a liquid condition, so as to expand the pellet generally along pin performance line 64. Beyond temperature 62 the waxes are fully transitioned to the liquid condition, so there is no substantial pin 42 motion.

FIG. 2 shows the valve when the wax mixtures are below transition temperature 60. Flow opening 32 is oriented to branch passage 20 so that flow opening 32 moves into fall registry with the branch passage port when the wax mixture reaches transition temperature 62. The temperature span, from 60 to 62, is selected to coincide with the piston 22 temperature range where oil spray cooling is required.

Branch 20 oil flow is modulated by flow opening 32 generally in accordance with piston cooling requirements. Higher piston 22 temperatures (within the high operating range) generate higher oil flows in branch line 20. When the oil is in the low temperature range (less than temperature 60 in FIG. 3) there is no oil flow through branch line 20. The system achieves effective use of the cooling oil, with minimal pumping expense. The pistons are cooled only when necessary, so that the pistons tend to remain hot enough for good engine performance under low load conditions.

The valve depicted in FIG. 2 can be a relatively small size item suitable for disposition in a reasonably sized cavity or oil passage in the engine. Tubular wall 28 is pressure balanced, such that opposite ends of the tubular wall are subjected to the same pressure; there is a minimal pressure drop through the valve, such that the necessary operating force can be developed by a relatively small power element 34.

Figure 4:
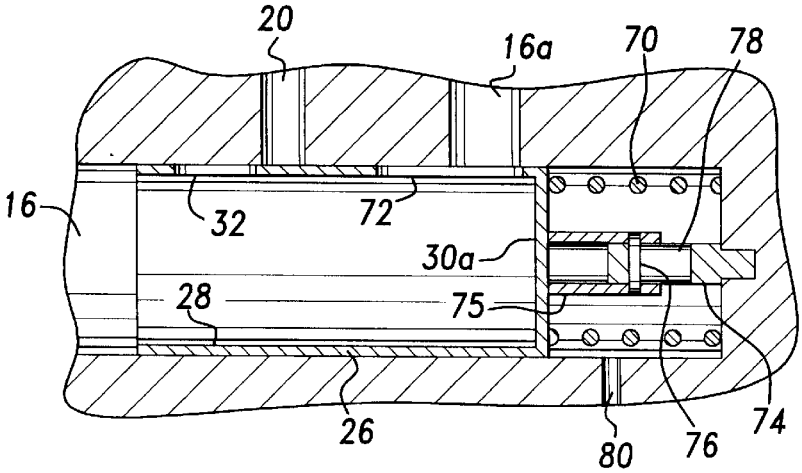
FIG. 4 is a sectional view taken through a pressure-responsive diverter valve embodying features of the invention.

FIG. 2 represents a preferred form of the invention. A alternate form of the invention is shown in FIG. 4. As shown, the tubular valve element 26 comprises a tubular wall 28 having a flow opening 32 adapted to register with branch passage 20 only when the oil pressure in main passage 16 is at a relatively high value associated with operation of the engine under high loads. At low and moderate loads the valve blocks oil flow into branch passage 20.

The position of tubular valve element 26 is controlled by a calibrated compression spring 70 having the necessary force spring rate, so that flow opening 32 achieves full registry with branch line 20 only operating at high load.

Tubular wall 28 (FIG. 4) has a second flow opening 72 of sufficient axial length as to remain in full registry with main outlet passage 16*a* during the entire stroke of the tubular valve. The stroke of valve 26 can be limited by any suitable stop mechanism. As shown in FIG. 4, the stop means comprises a stationary rod 74 and telescoping sleeve 75 carried by end wall 30*a* of the valve. A transverse pin 76 extends across sleeve 75 through a slot 78 in rod 74. The length of slot 78 determines the stroke of the valve element.

It is further contemplated that a screw or bolt 29 may be threaded through the main oil passage and index an axial slot 31 in the wall 28 of valve 26. The screw prevents the rotation of the valve and thereby facilitates the use of oil holes 33, rather than grooves in the spool valve.

A drain passage 80 is provided for directing any leakage oil out of the spring chamber. The use of axial flow openings 32 and 72 (rather than annular groves) minimizes such leakage. Also, the use of flow openings (rather than grooves) permits a greater valve element stroke, with a more precise control of the oil metering function.

As noted above, FIG. 2 represents a preferred form of the invention. The construction of FIG. 4 represents a low cost alternative that can be used.

Figure 5:
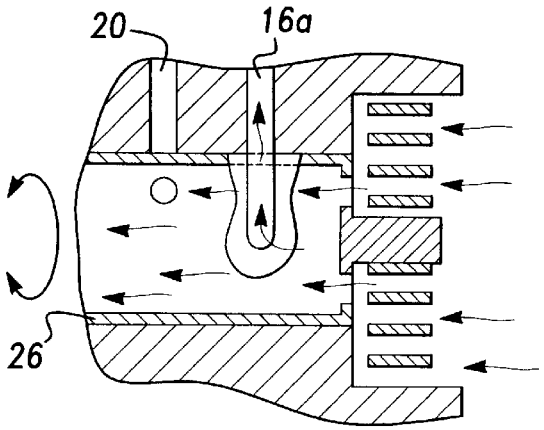
FIG. 5 is a sectional view of one form of rotational control of the diverter valve.

It is further contemplated that the oil flow may be controlled through rotational movement of valve sleeve 28. Specifically, and referring to FIG. 5, there is depicted therein valve sleeve 28 having a series of openings therein adapted to be aligned with various branch passes 16. A bimetallic spring 27 is contained within a cavity 21 and attached to the sleeve valve via flange 26 and one end and attached to the engine housing in the conventional manner. The bimetallic spring may be actuated by oil pressure or oil temperature to expand and contract as necessary to thereby rotate the sleeve and position the openings either in alignment with the branch passages, or to interrupt the flow of oil through the branch passages by rotating the opening away from alignment therewith.

Figure 6:
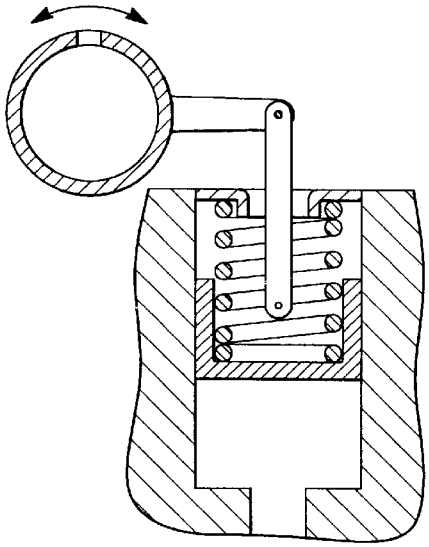
FIG. 6 is a sectional view of another rotational valve control mechanism.

Turning to FIG. 6, another embodiment of a rotational actuating device is depicted. Specifically, a servo piston 23 is positioned in the main oil passage and a calibrated spring 37 biases the servo piston in one position. The valve wall 28 is equipped with a flange arm 25 which is pivotally connected to the servo piston by connecting arm 19. When the oil pressure reaches a certain predetermined level, the servo piston is forced against the spring, and the connecting arm acts against the flange arm and rotates the valve. In this manner, it is contemplated that in one position, oil is blocked from the branch passages, and upon rotation, oil moves through the openings in the valve wall and into the ports of the branch passages. It is further contemplated that one could use a thermatic wax pellet motor to actuate the rotational movement in response to oil temperature rather than oil pressure.

Figure 7:
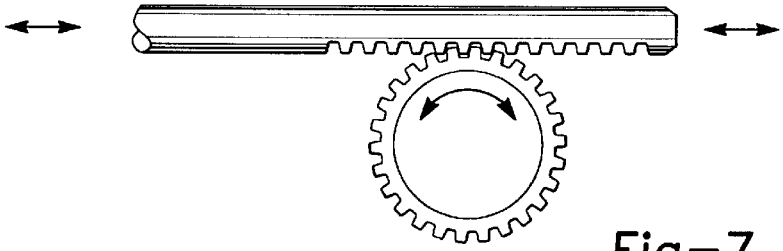
FIG. 7 is a sectional view of another rotational valve control mechanism.

Finally, turning to FIG. 7, there is a rack and gear mechanism for the rotational movement of the spool valve. Specifically, valve 26 is provided with gear teeth 17 carried upon valve wall 28, which meshingly engage gear teeth 15 on rack control rod 13. In this manner, it is possible to effect rotational movement of the spool valve by linear movement of the rack control rod in response to a range of parameters, such as oil temperature, oil pressure, or by way of an electronically controlled solenoid which is activated by any engine electronic control module (ECM) parameters. Examples of ECM parameters which may be used include, but are not limited to, oil pressure, oil temperature, fuel flow, engine load, engine speed, etc. It should be understood that any ECM parameter can be used to effect the actuation of the diverter valve.

Those skilled in the art will appreciate that many variations on the basic structures are possible without departing from the scope and spirit of the invention as set forth in the appended claims.

I claim:

1. In a piston engine having lubricated surfaces, and means for spraying lubricant onto the pistons for cooling purposes:

the improvement comprising a lubrication system that includes a lubricant pump;

a main oil passage in the engine connected to said pump for delivering oil to the engine lubricated surfaces;

at least one branch oil passage leading from said main passage to the lubricant spray means, said branch passage intersecting said main passage at an angle to form a port;

a valve element comprising a hollow tubular wall sideably positioned in said main passage for movement across said port;

said tubular wall having a flow opening therein registerable with said port;

and a thermal power means mounted in said main passage; said thermal power means being connected to said valve element for back and forth reciprocation of the valve element in the main passage, whereby said tubular wall blocks oil flow into the branch passage when the thermal power means is in a low temperature range and said flow opening permits oil flow into the branch passage when the thermal power means is in a high temperature range.

2. The improvement of claim 1, wherein said thermal power means comprises a fusible material that transitions between a solid and liquid condition over said high temperature range, whereby the flow rate in the branch passage increases as the temperature of said thermal power means increases in said high temperature range.

3. The improvement of claim 1, wherein said thermal power means comprises a cylinder, a pin slidable in and out of said cylinder, and a spring means basing said pin into the cylinder; said valve element being affixed to said pin for movement therewith.

4. The improvement of claim 3, and further comprising means for mounting said thermal power means in said main passage; said mounting means comprising a bracket having an outer edge area affixed to the main passage surface and an inner edge area affixed to said cylinder, whereby the cylinder has a fixed position in the main passage.

* * * * *